US005326183A

United States Patent [19]

Kasai et al.

[11] Patent Number: 5,326,183

[45] Date of Patent: Jul. 5, 1994

[54] CARRIAGE SPEED CONTROL BASED ON AVERAGE DOT DENSITY

[75] Inventors: Tadashi Kasai; Jiro Tanuma; Naoji Akutsu; Hideaki Ishimizu; Chihiro Komori, all of Tokyo, Japan

[73] Assignee: Oki Electric Industry Co., Ltd., Tokyo, Japan

[21] Appl. No.: 791,389

[22] Filed: Nov. 14, 1991

[30] Foreign Application Priority Data

| | | | |
|---|---|---|---|
| Nov. 16, 1990 | [JP] | Japan | 2-308649 |
| Feb. 7, 1991 | [JP] | Japan | 3-038178 |
| Aug. 21, 1991 | [JP] | Japan | 3-233840 |

[51] Int. Cl.[5] ..... B41J 19/30

[52] U.S. Cl. ..... 400/279; 400/121; 400/322

[58] Field of Search ..... 400/279, 320, 322, 120, 400/121

[56] References Cited

FOREIGN PATENT DOCUMENTS

| | | | |
|---|---|---|---|
| 57-047673 | 3/1982 | Japan | 400/279 |
| 59-035965 | 2/1984 | Japan | 400/279 |
| 60-244559 | 12/1985 | Japan | 400/279 |
| 61-094769 | 5/1986 | Japan | 400/279 |
| 61-134275 | 6/1986 | Japan | 400/279 |
| 61-42632 | 9/1986 | Japan | 400/279 |
| 61-270163 | 11/1986 | Japan | 400/279 |
| 62-236774 | 10/1987 | Japan | 400/279 |
| 19348 | 4/1989 | Japan | 400/279 |

*Primary Examiner*—David A. Wiecking
*Assistant Examiner*—Steven S. Kelley
*Attorney, Agent, or Firm*—Spencer, Frank & Schneider

[57] ABSTRACT

Printing control includes determining printing dot density of print data to be supplied to a printing head, averaging the printing dot density during a predetermined period of time based on the printing dot density determined, selecting a printing speed in response to the average value of printing dot density, and controlling printing to print at the selected printing speed.

10 Claims, 13 Drawing Sheets

| ADDRESS | DATA |
|---|---|
| 0 0 0 0 0 0 0 0 | 0 0 0 0 0 0 0 0 |
| ⋮ | ⋮ |
| 1 0 1 0 1 1 0 0 | 0 0 0 0 0 1 0 0 |
| 1 0 1 0 1 1 0 1 | 0 0 0 0 0 1 0 1 |
| 1 0 1 0 1 1 1 0 | 0 0 0 0 0 1 0 1 |
| 1 0 1 0 1 1 1 1 | 0 0 0 0 0 1 1 0 |
| 1 0 1 1 0 0 0 0 | 0 0 0 0 0 0 1 1 |
| ⋮ | ⋮ |
| 1 1 1 1 1 1 1 1 | 0 0 0 0 1 0 0 0 |

FIG. 4

CARRIAGE SPEED CONTROL BASED ON AVERAGE DOT DENSITY

BACKGROUND OF THE INVENTION

1. Field of the Invention

The present invention relates to a printing control method for a printer, wherein the printing speed is controlled depending on the printing contents to be printed by a printing head.

2. Description of the Prior Art

In an ordinary printer, a printing head is placed to face printing paper on a platen, and is driven in accordance with printing data while a spacing motor is controlling the spacing action of this printing head in the primary scanning direction of the printing paper. Here, spacing means the operation in which the printing head is moved in the direction perpendicular to the direction of printing paper delivery.

In the case of a wire-dot type printing head, since many wires must be electrically driven, a large amount of electrical power is needed. Also, in the case of a printer which uses a thermal head with a large number of thermal elements, a lot of electrical power is needed, depending on the printing data. At the same time, a spacing motor, which spaces the printing head in the primary scanning direction, also consumes a large amount of electrical power. A single electrical power source is used to drive both the thermal head and spacing motor.

However, recently, there have been strong demands to make the printer small and light, less expensive, multi-functional, and less power consumptive, which translates into strong demands for minimizing the capacity of the electrical power source.

If the spacing speed of the printing head is increased, proportionally more power is consumed. Therefore, it is feared that if it is desired to perform high density printing at high speed, the power source capacity may be exceeded. That is, if graphic characters and the like are printed during high speed printing, the power supplied to the printing head becomes insufficient, reducing the printing density.

In the past, various methods were adopted in order to solve such a problem. For example, the spacing speed was reduced in the case of graphic printing in which printing dot density is high compared to printing of ASCII characters.

Further, if such a control is performed for each unit line, the overall printing speed slows down even for the line containing only one graphic character since the printing speed slows down for this character. Therefore, a device had been introduced (Japanese Patent Publication No. 42632/1986), in which the printing speed was different between Chinese characters and others and the printing head was controlled to reduce the printing speed if the count of Chinese characters mixed in each line of printing exceeded a prescribed value.

Further, another device, explained below, had been developed for the same purpose (Japanese Patent Publication No. 19348/1989). FIG. 2 shows a block diagram showing the essential section of this prior printer. In the device, printing action is controlled by control section 1. This device is provided with head driving circuit 2, printing head 3, motor driving circuit 4, spacing motor 5, analog/digital conversion circuit 6, logic circuit power source 7, power source 8, voltage detection circuit 9, and digital/analog conversion circuit 10.

Head driving circuit 2 is a circuit for controlling the printing action of printing head 3, and operates by receiving its power from power source 8. Motor driving circuit 4 is a circuit for controlling spacing motor 5, and supplies spacing motor 5 with pulses proportional to a necessary spacing speed if spacing motor 5 is a pulse motor. This motor driving circuit 4 is also supplied with power by power source 8. Logic circuit power source 7 is a power source for supplying control section 1 with operational power.

Furthermore, control section 1 supplies head driving circuit 2 with printing data, supplies motor driving circuit 4 with a control voltage through digital/analog conversion circuit 10, and controls the spacing so as to be performed at a set speed. Incidentally, motor driving circuit 4 and analog/digital conversion circuit 6 and digital/analog conversion circuit 10 constitute a servo system for spacing motor 5 and control the spacing so as to be performed at a set speed.

More specifically, motor driving circuit 4 supplies spacing motor 5 with control power proportional to the set speed, and spacing motor 5 rotates at the set speed. Spacing motor 5 is provided with a rotation detection sensor, not illustrated, such as a rotary encoder, and the output from this sensor is sent to analog/digital conversion section 6, digitalized, and inputted to control section 1. Control section 1 recognizes the actual speed of spacing motor 5 and increases or decreases the control voltage outputted to digital/analog conversion section 10, so that the spacing is performed at the set speed.

Here, this device is configured so that voltage detection circuit 9 detects the output voltage of power source 8, sends the output to the above mentioned servo system in order to control variably the spacing speed of spacing motor 5.

Specifically, power source 8 simultaneously supplies head driving circuit 2 and motor driving circuit 4 with their driving power. Here, in the case of a printing contents such as graphic data or Chinese characters, wherein printing head 3 consumes a large amount of power to print, the source voltage of power source 8 drops, as motor driving circuit 4 tries to drive spacing motor 5 at a high speed.

Voltage detection circuit 9 detects this voltage drop and sends the above mentioned servo system a command to slow down the spacing speed. In this servo system, when digital signals proportional to the spacing speed are sent out from control section 1, they are converted to a corresponding analog voltage in digital-/analog conversion circuit 10, and motor driving circuit 4 is controlled by this analog voltage.

Voltage detection circuit 9 adjusts the control voltage outputted from digital/analog conversion circuit 10 based on the printing contents. For example, it controls the spacing speed to be faster in the case of ASCII characters and slower in the case of graphic characters.

According to such arrangement, since the spacing speed is adjusted when power voltage actually drops, the total printer throughput can be increased in comparison to the case in which the spacing speed is uniformly set for each unit line.

Further, in the case of a printer with a wire-dot type printing head, large noises are generated while printing is going on, since many wires are driven. Because this noise level has a positive correlation with the number of impacts per unit time, if the printing speed is increased, the noise level gets higher accordingly. Therefore, in order to lower the noise level, the printing speed had better be decreased, but the operating speed of a printer is slow compared to other I/O devices, and demands for improving the operating speed, in other words, the printing speed, are strong. Because of this reason, it is necessary to increase the printing speed as much as possible, which brings out results that are contrary to noise level reduction.

In order to handle this contradiction, there was a method in which a normal printing mode and a low noise level printing mode were provided so as to offer a selection during printing. Most of the noises from a printer belong to the noises generated during actual printing actions, especially those generated by printing head 3, and this printing sound is positively correlated to the number of impacts per unit time. Therefore, in order to reduce the number of impacts per unit time, printing was done at a lower printing speed in the low noise printing mode, rather than in the normal printing mode.

Further, this low noise printing mode was set by a control command from a host computer, not illustrated, or by an input through a switch on an operating console panel, not illustrated, and the switching was made, by control section 1, from the mode with a normal printing speed to the mode with a low noise printing speed, which is slower than the normal printing speed, and then the printing continued.

However, if the spacing speed is variably controlled corresponding to the printing contents as mentioned above, spacing motor 5 is accelerated or decelerated while proceeding in the primary scanning direction.

Generally speaking, the relationship between the spacing interval and the spacing speed during acceleration or deceleration can be expressed by following equation.

$$X=(V^2-V0^2)2\alpha \quad (1)$$

where X represents a spacing interval, V a spacing speed, VO an initial speed of the printing head, and $\alpha$ represents an acceleration. As is evident from this equation, with acceleration $\alpha$ being kept constant, the moving distance X from the beginning of acceleration to the time when a target speed is achieved becomes quadrupled if the target speed is doubled.

FIG. 3 shows an explanatory diagram showing the operation of the printer shown in FIG. 2. FIG. 3(*a*) is a graph in which power source voltage VP is plotted on the vertical axis and printing location (spacing interval) X on the horizontal axis. FIG. 3(*b*) is a graph in which printing speed (spacing speed) V is plotted on the vertical axis and printing location X on the horizontal axis. Furthermore, FIG. 3(*c*) is a graph in which the number of printing dots n is plotted on the vertical axis, and printing location X on the horizontal axis.

These graphs show the changes of power source voltage corresponding to the number of printing dots when the initial output voltage VP of power source 8 is VP0 and the printing speed is V0, and in addition, show the changes of the same power source voltage when the printing speed is increased to twice V0 in order to increase the printing speed.

Incidentally, the printing pattern is set, as is shown in FIG. 3(*c*), so that the printing head travels left to right from location X1 to location X4 without taking printing actions until it reaches location X2, prints in 24 dot format from location X2 to location X3, and does not print beyond that point.

Here, with the printing speed being V0, the printing head prints in 24 dot format at printing location X2, and meanwhile, the power supply from power source 8 to head driving circuit 2 increases. At this time, if the output voltage is detected by voltage detection circuit 9, the speed of spacing motor 5 is decreased at printing location X5 and is stabilized to V1 at printing location X7. Incidentally, the power source voltage drops to VP1 in this case. When the printing head passes printing location X3 where printing in 24 dot format ends, power source voltage recovers to VP0 and spacing motor 5 is accelerated again to V0.

On the other hand, in the case of printing speed 2V0, when 24 dot printing begins at printing location X2, power source voltage VP0 suddenly drops, and in response to this drop, the printing speed is reduced to V1. However, because the initial printing speed is fast, the printing speed finally slows down to V1 when the printing head arrives at printing location X8. Past this point, printing goes on at this constant speed of V1 until the printing head arrives at printing location X3 where the number of printing dots returns to "0," and past printing location X3, the printing speed is accelerated back to the initial printing speed of 2V0.

It is the interval [1] in FIG. 3(*a*) where a problem occurs. In this interval, printing head 3 must perform printing at printing speed V1, at which a proper balance is maintained between the power for printing and the power for driving the spacing motor, but printing continues without changing speed from the fast speed.

The relationship expressed by the above Equation (1) equally holds true for both acceleration and deceleration cases, and power source 8 outputs the same amount of power to motor driving circuit 4 for the deceleration of spacing motor 5 as for the acceleration. Therefore, power source 8 is required to output more power than its capacity in interval [1] in FIG. 3(*a*) and the power to be supplied to printing head 3 becomes insufficient. As a result, in the case of a wire-dot type head, for example, printing errors such as faint prints or missing dots occur. Needless to say, the same phenomena also occur during acceleration.

As a matter of fact, if a motor with better acceleration and deceleration response or a power source with a larger capacity is used, problems such as the above do not occur. However, a motor with better acceleration and deceleration response becomes large, and increasing the power source capacity results in an increased size of the power source itself. Therefore, the problems could not be solved by such a method as described above since there is a demand to reduce the size and costs of printers.

Furthermore, the printing control device of the prior printer controlled the printer so as to operate in the low noise printing mode regardless of the printing contents in order to reduce the number of impacts per unit of time. However, since such a control method made the printing speed uniformly slow however or not a printing pattern had a low printing dot density, and therefore had a relatively low noise level, there was a problem that the total throughput for the printer decreased.

Furthermore, as an attempt to obtain a low noise printer without reducing the throughput, the installation of sound proofing or sound shielding structure was practiced, but in this case, there was a problem that the addition of sound proofing or sound shielding structures led to cost increases.

SUMMARY OF THE INVENTION

It is therefore an object of the present invention to provide, in consideration of the above mentioned problems, a printing control device which is small, light and able to not only perform fast and high quality printing, and keep the printer noise level low, but also maintain the throughput loss at a minimum, and a control method thereof.

The printing control device of the present invention includes a printing head driven by a head driving circuit, a controller, a power source, a spacing controller, and a signal convertor.

The controller consists of a printing dot density detector to detect the printing dot densities based on the printing data supplied to the above mentioned printing head, an averaging unit to average the printing dot densities detected by the above mentioned printing dot density detector within a prescribed time frame, and a printing speed controller to control the printing speed to be set according to the averaged printing dot density obtained by the above averaging unit. The power source consists of a logic circuit power source to supply the logic circuit of the above mentioned controller with electrical power, and a power source to supply the above mentioned head driving circuit and motor driving circuit with electrical power.

The spacing controller consists of a spacing motor that is driven by the above mentioned motor driving circuit and which sends analog signals to the above mentioned control section.

The signal conversion unit consists of a digital-/analog convertor to convert the digital signals from the above mentioned control section to analog signals which are sent to the above mentioned motor driving circuit, and an analog/digital convertor to convert the analog signals from the above mentioned spacing motor to digital signals.

Furthermore, the above mentioned printing head and power source may be provided with an identifier to send to the above mentioned controller a signal for identifying the grade of the printing head and a signal for identifying the grade of the power source, respectively. Also, the above mentioned controller which receives I/F (interface) signals may be connected to a console panel.

In this printing control device of the present invention, the sequential changes of printing dot density are detected, based on the printing data supplied to the printing head, to be averaged within a prescribed time frame and used for selecting a proper printing speed matching this averaged printing dot density. Furthermore, in the event the printing head and the power source are provided with grade identifiers to identify the printing head grade and the power source grade, respectively, the signals from those identifiers may be combined by the controller with the above mentioned printing data, along with I/F signal and operational signal from the console, to be used to detect the sequential changes of printing dot density.

In addition, the above mentioned averaged sequential printing dot density may be used to search for the printing areas having a printing dot density higher than a prescribed one, and if such areas are detected, a prescribed printing speed matching the above mentioned averaged printing dot density is selected and the printing speed is reduced before the above mentioned areas so that the selected slow printing speed can be achieved before such areas are reached.

Therefore, the printing control device and printing control method of the present invention can bring out the maximum printing performance without increasing the size and cost of the power source, and also offer an optimum balance between printing performance and noise level.

BRIEF DESCRIPTION OF THE DRAWINGS

The objects and features of the present invention will become more apparent from the consideration of the following detailed description taken in conjunction with the accompanying drawings in which:

FIG. 4 is an explanatory drawing schematically showing the printing dot density detection section of the preferred embodiment shown in FIG. 1;

DESCRIPTION OF THE PREFERRED EMBODIMENTS

Figure 1:
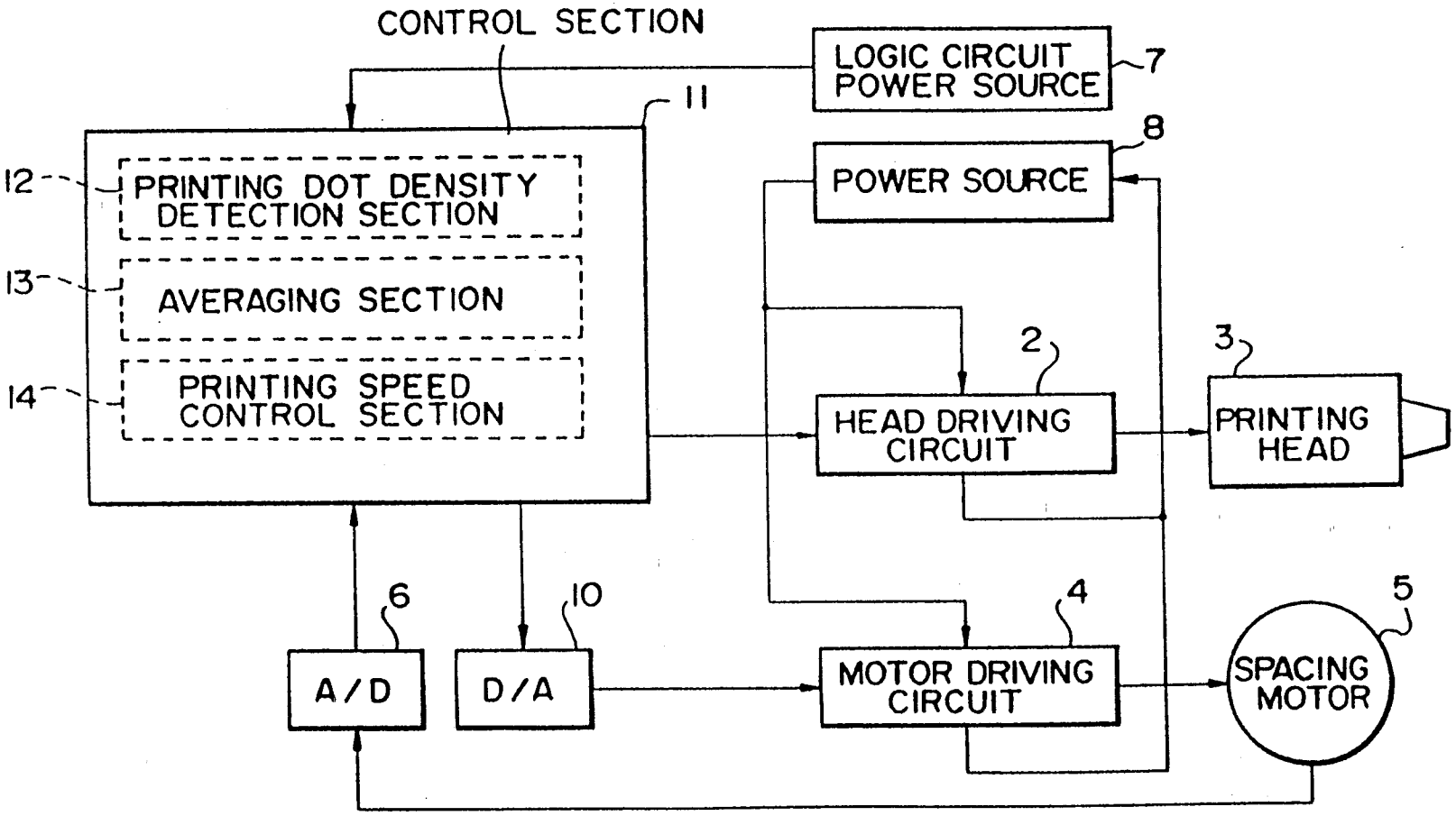
FIG. 1 is a block diagram of the essential section of a printer schematically showing a preferred embodiment to which the printing control of the present invention is applied.

Below, the preferred embodiments of the present invention are explained in detail referring to the drawings. FIG. 1 is a block diagram of the essential section of a printer that implements the method of the present invention. The device in the figure is provided with control section 11, head driving circuit 2, printing head 3, motor driving circuit 4, spacing motor 5, analog/digital conversion circuit 6, logic circuit power source 7, power source 8, and digital/analog conversion circuit 10.

Head driving circuit 2 is a circuit for controlling the printing action of printing head 3, and operates by receiving its power from power source 8. Motor driving circuit 4 is a circuit for controlling spacing motor 5 and supplies spacing motor 5 with pulses proportional to a necessary spacing speed if spacing motor 5 is a pulse motor. This motor driving circuit 4 also supplied with power by power source 8. Logic circuit power source 7 is a power source for supplying control section 1 with operational power.

Furthermore, control section 11 supplies head driving circuit 2 with printing data, supplies motor driving circuit 4 with control voltage through digital/analog conversion circuit 10, and controls spacing to be performed at a set speed. Incidentally, motor driving circuit 4, analog/digital conversion circuit 6, and digital-/analog conversion circuit 10 constitute the servo system for spacing motor 5, and controls the spacing so as to be performed at a set speed.

More specifically, motor driving circuit 4 supplies spacing motor 5 with controlling the electrical power proportional to the set speed, and spacing motor 5 rotates at that speed. Spacing motor 5 is provided with a rotation detection sensor, not illustrated, such as a rotary encoder, and the output of this sensor is sent to analog/digital conversion section 6, digitalized, and inputted to control section 1. Control section 1 recognizes the actual speed of spacing motor 5 and increases or decreases the control voltage outputted to digital-/analog conversion section 10, so that spacing is performed at the set speed.

Here, this device is configured so that voltage detection circuit 9 detects the output voltage of power source 8 and sends this output to the above mentioned servo system in order to variably control the spacing speed of spacing motor 5.

Specifically, power source 8 simultaneously supplies head driving circuit 2 and motor driving circuit 4 with their driving power. Here, in the case of printing contents such as graphic characters or Chinese characters, wherein printing head 3 consumes a large amount of power to print, the source voltage of power source 8 drops as motor driving circuit 4 tries to drive spacing motor 5 at a high speed.

Figure 2:
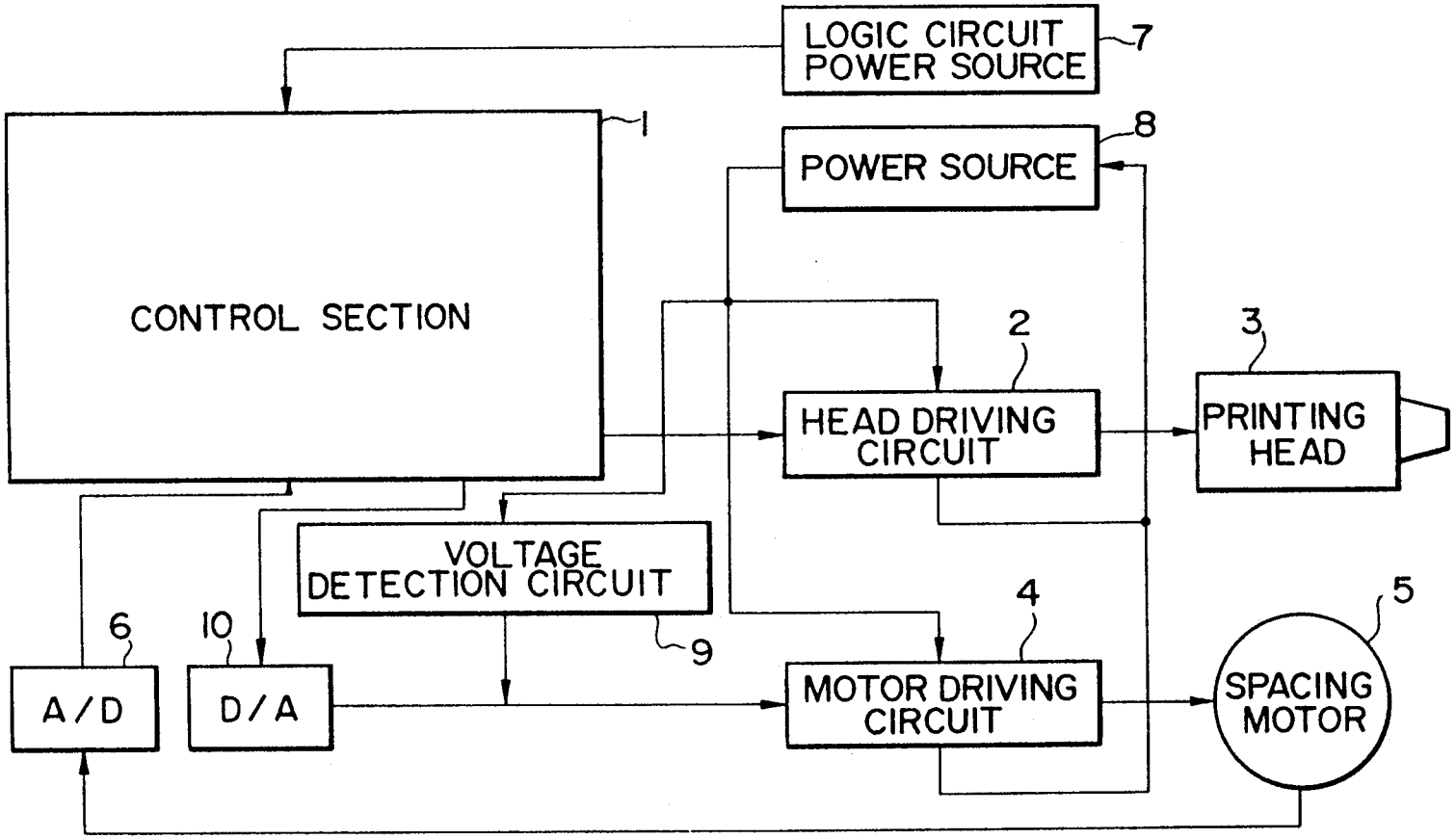
FIG. 2 PRIOR ART
FIG. 2 is a block diagram schematically showing the essential section of a prior printer.
Figure 3:
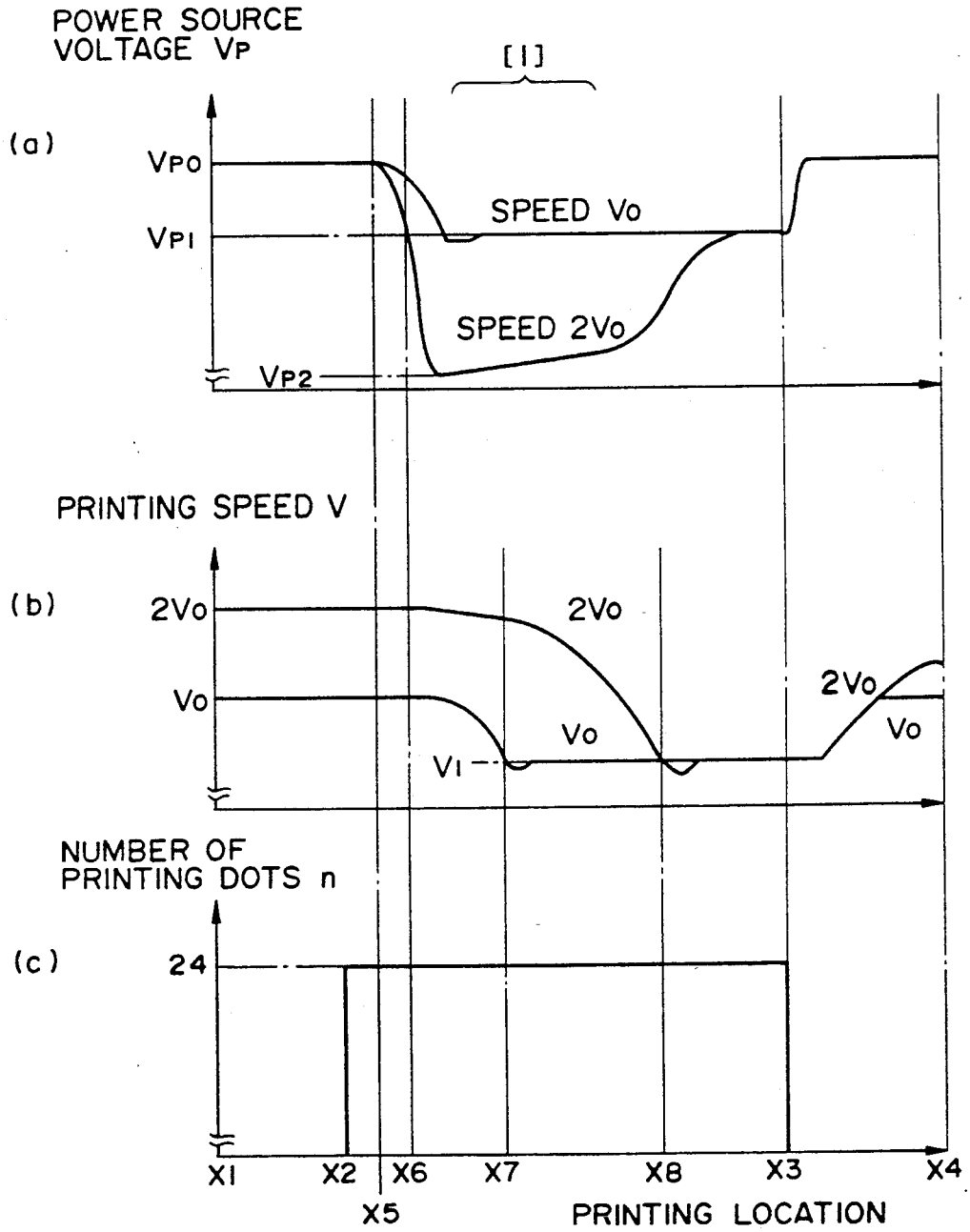
FIG. 3 is an explanatory drawing schematically showing the operation of the prior printer shown in FIG. 2.

Here, in order to implement the method of the present invention, voltage detection circuit 9 of the prior printer shown in FIG. 2 is eliminated, and printing dot density detection section 12, averaging section 13 and printing speed control section 14 are newly added.

Printing dot density detection section 12 consists of a circuit that detects the printing dot density based on the printing data for the printing contents which is going to be printed next.

Furthermore, averaging section 13 is a digital filter or the like and consists of a circuit which averages the printing dot density detected by printing dot density detection section 12 within a prescribed time frame. Printing speed control section 14 is a circuit that selects one of the printing speeds established in proportion to these averaged printing dot densities and functions to supply motor driving circuit 4 with a control voltage through digital/analog conversion circuit 10.

Here, the printing dot density detection section is explained, referring to FIG. 4. This figure is an explanatory drawing for the section. Printing dot density detection section 12 is provided with an ROM table in which the data shown on the right side are stored at the addresses shown on the left. At the addresses of this ROM table, all of the printing patterns for the eight dot segment established by dividing the 24 pin printing head into three sections are displayed. With eight bits, 256 types of printing patterns exist. Corresponding to this, the numbers of pins to be driven are displayed on the data side for each printing pattern, Therefore, if the printing data is fed to this printing dot density detection section 12, the number of pins to be actually driven can be obtained by means of referring to the ROM table. For example, in the case of the full-pin printing using all 24 pins, the hexadecimal value 18H=24 in decimal is obtained by adding DATA=08H stored at address FFH, three times. Incidentally, this kind of function can be provided by a hardware logic using other types of adders, without relying on the ROM table.

When a 24 pin printing head is driven, the data sent to the printing head is divided into three sections, and if the data obtained by sending respectively these divided data to printing dot density detection section 12 are totaled, the number of pins to be driven for a single printing action can be obtained. This number of pins is called printing dot density, and the sequential change in this density becomes the basis for the printing speed control described below.

Figure 5:
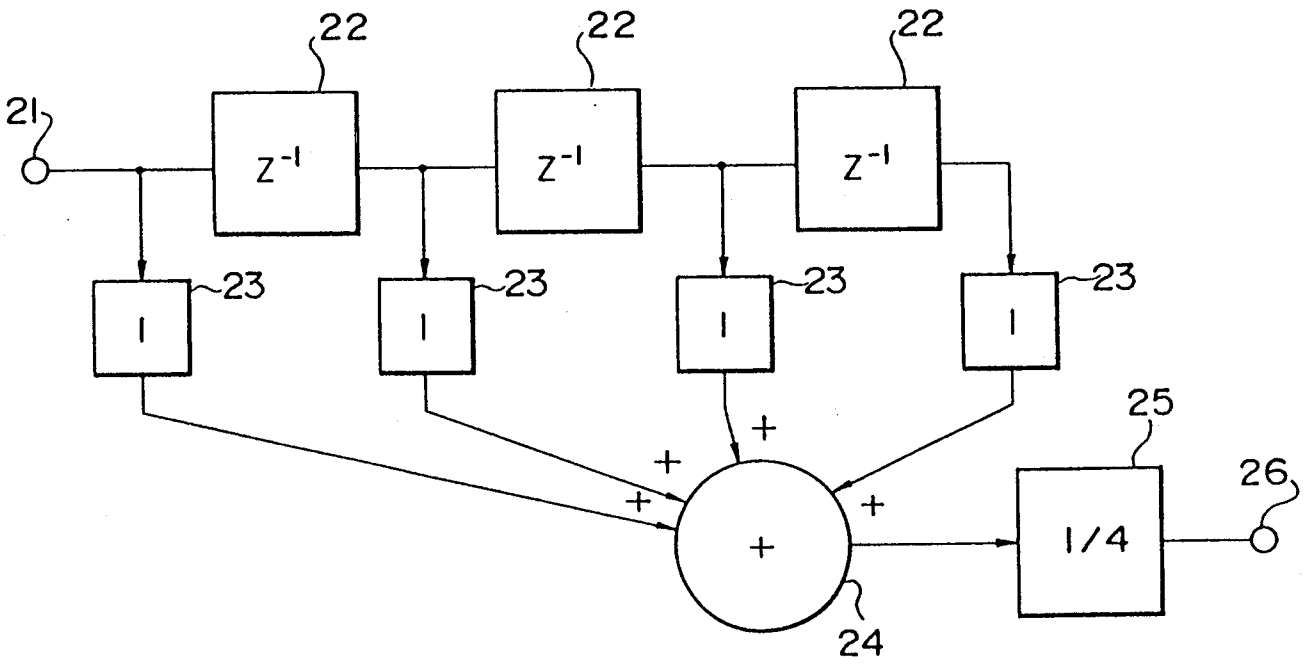
FIG. 5 is a block drawing schematically showing the digital filter which is employed in the preferred embodiment shown in FIG. 1.

FIG. 5 shows a block diagram of a digital filter functioning as averaging section 13 shown in FIG. 1. The digital filter in the figure consists of three registers 22 (designated as $Z^{-1}$) which are connected in series to input terminal 21, four analog multipliers 23 which receive input signals and the outputs from respective registers 22 and weight them, adder 24 which adds the outputs from these analog multiplier 23, and analog divider 25 which divides the output from adder 24 to normalize it. It is designed so that the output of analog divider 25 is outputted toward output terminal 26.

The above mentioned three registers 22 delay each input signal by one clock unit and in the end, play the role of averaging the printing dots within a prescribed time frame. More specifically, in this case, it is configured so that four consecutive printing data for driving the printing head are weighted by respective analog multipliers 23, normalized by adder 24 and analog divider 25, and outputted. Needless to say, such arithmetic calculations can be also performed by programming a microprocessor or by the use of a dedicated gate array hardware.

If the arithmetic function of this digital filter is expressed by an equation, following Equation (2) is obtained.

$$Ave[n(x)]=\{n(x)+n(x-1)+n(x-2)+n(x-3)\}/4 \quad (2)$$

In this equation, n(x) indicates the number of printing dots at printing location X, and Ave[n(x)] is a value which is obtained by averaging the numbers of printing dots for the three preceding printing locations before printing location X.

Figure 6:
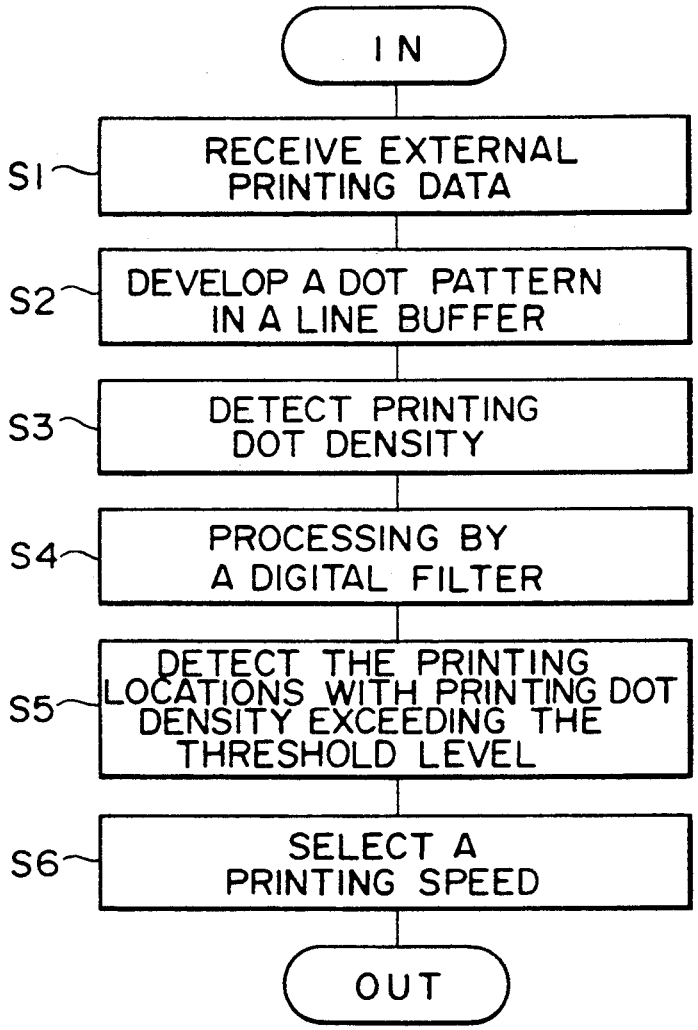
FIG. 6 is an operational flow chart for the same preferred embodiment.
Figure 7:
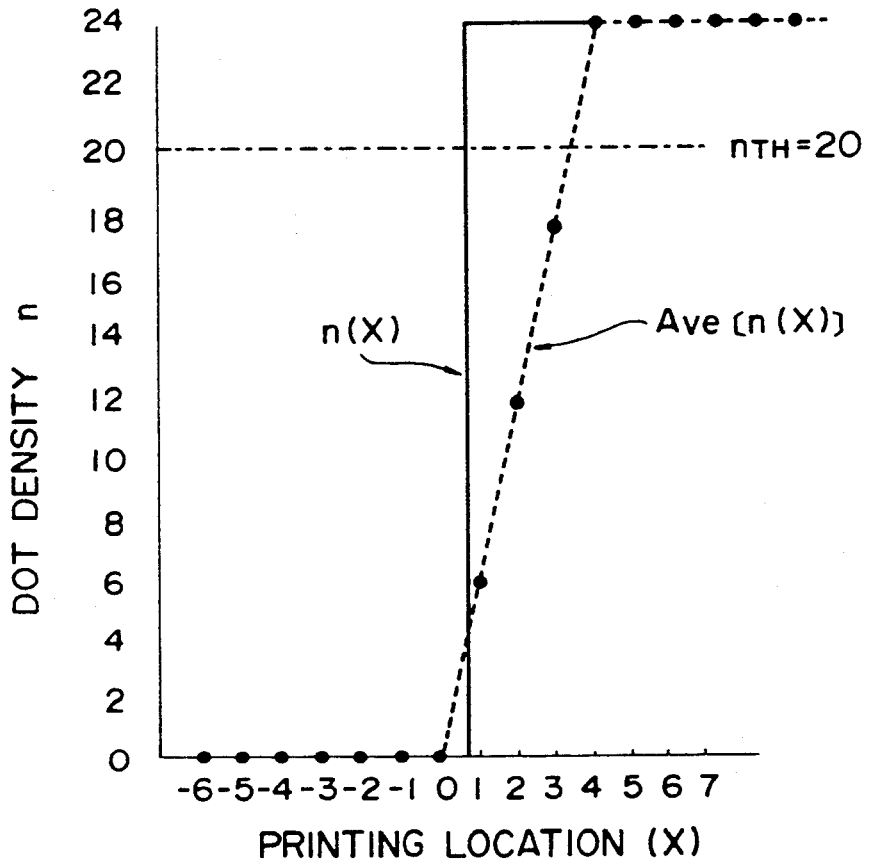
FIG. 7 is an explanatory drawing showing schematically showing the operation of the digital filter shown in FIG. 5.

The printing control method for the printer of the present invention with above configuration is more concretely explained below referring to FIGS. 6 and 7. FIG. 6 is an operational flow chart of the preferred embodiment showing the method of the present invention and FIG. 7 is an explanatory diagram showing the operation of the above mentioned digital filter. First, in FIG. 6 (Step 1), if control section 11 shown in FIG. 1 externally receives the printing data, it develops a line buffer head pattern (Step 2). Next, printing dot density detection section 12 detects the printing dot density in the manner explained before, referring to FIG. 4 (Step 3). Then, the digital filter averages the printing dot densities during a prescribed time frame in the manner explained before referring to FIG. 5 (Step 4).

The horizontal axis of FIG. 7 represents printing location X and the vertical axis dot density n. Here, it is assumed that the printing data is such that the printing state suddenly rises to a 24 dot printing state from a no-printing state between printing location 0 and printing location 1. If such printing data are processed by the filter explained above, its output takes a value which changes relatively gradually as is shown by the broken line in the figure. Incidentally, in this example, the time frame for averaging is set to cover four printing locations.

Furthermore, even if the sequential change in the printing dot density is sudden, processing in this manner by the digital filter renders the change gradual and gives outputs as if the high frequency components were eliminated by a low-pass filter in an analog circuit.

Next, printing speed control section 14 of control section 11 shown in FIG. 1 compares the output of averaging section 13 to a prescribed threshold level n th which is retained by control section 11. Here, n th is set to be "20," for example. In other words, if the printing dot density exceeds n th, the printing speed is set at a slow speed, and if it is less than n th, at a high speed.

In FIG. 6, the printing line sections where the printing dot density exceeds the above mentioned threshold level is detected in Step 5, and then the printing speed is selected in Step 6.

Such selection of the printing speed is controlled so as to be made before actual printing action takes place so that the printing speed is reduced and stabilized by the time actual high density printing action takes place.

Here, the above mentioned threshold level n th is explained in further detail. It is defined that this value becomes the maximum number of printing dots at which output voltage VP of power source 8 (FIG. 1) does not drop below a predetermined voltage when printing is continued with the number of printing dots being fixed.

If n th is "20," for example, it means that, when printing is continued with the number of printing dots being more than 20, voltage VP gradually drops and becomes unable to drive the printing head, effecting faint and dim prints, even though normal printing is initially possible for a short time by releasing the power stored in the power source. Therefore, in the case of a printing dot density at which the number of printing dots exceeds 20, the printing speed must be lowered in order to reduce the printing load so that printing quality is maintained.

On the other hand, it is rare that the number of printing dots consecutively exceeds 20 in an actual printing pattern, and in many cases, the printing locations where the number of printing dots exceeds 20 are interspersed. Therefore, if the printing speed is reduced at every such location where the number of printing dots exceeds 20, its processing capacity as a printer declines. Also, if it is for a short time, it is possible to continue normal printing, depending on the power stored in a condenser or the like provided in the power source, at such locations where the number of printing dots exceeds 20.

Therefore, sudden sequential changes in the printing density are averaged by the above mentioned digital filter, so that only the locations where the printing dot density averages are high are actually detected to select the printing speed. For example, in the example in FIG. 7 explained before, printing can be continued at a normal speed until 24 dot printing consecutively occurs three times.

The present invention is not limited to the above preferred embodiment. For example, the function of the digital filter shown in FIG. 5 can be generalized by following Equation (3).

$$Ave[n(x)]=\{a0\cdot n(x)+a1\cdot n(x-1)+a2\cdot n(x-2)+\ldots +a(k-1)\cdot n(x-(k-1))\}/\{a0+a1+a2+\ldots +a(k-1)\} \quad (3)$$

Here, k, a0, a1, a2 . . . a (k−1) are optional constants.

Incidentally, all of the above mentioned a0, a1, . . . are values to be established for weighting purposes in analog multiplier 23 shown in FIG. 5. In other words, it becomes evident whether it is possible to determine how high the printing dot density can be in order for a certain printing pattern to be printed in how long a time frame, and the printing dot density during each specific time frame can be properly weighted based on these conditions and normalized to obtain the data for the printing speed selection.

Figure 8:
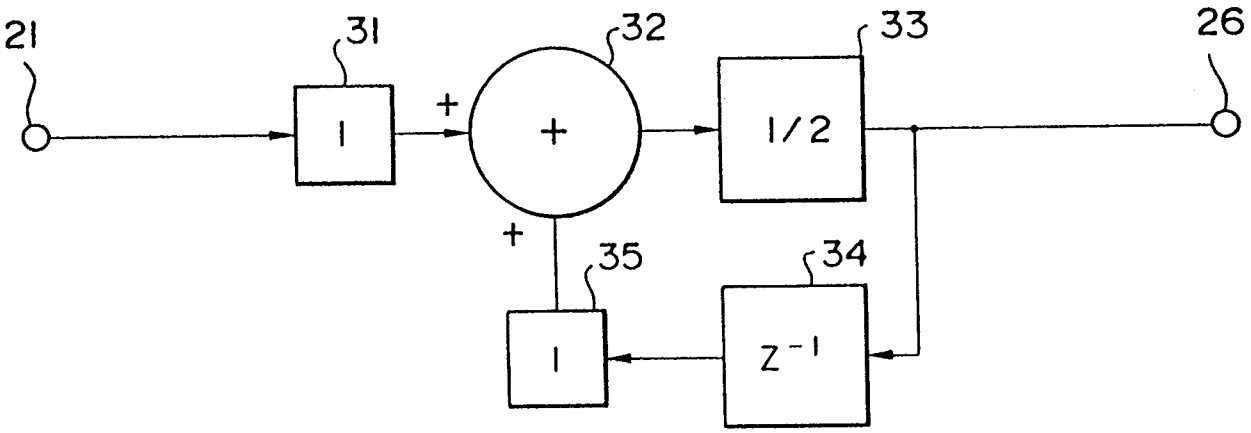
FIG. 8 is a block diagram schematically showing an alternative embodiment of the digital filter.

Also, the following processing is possible by using a digital filter with a different configuration. FIG. 8 is a block diagram showing an alternative embodiment of the digital filter. The digital filter in the figure has analog multiplier 31, analog adder 32, and analog divider 33 which are connected in series to input terminal 21. The output of adder 32 is inputted to analog divider 33, and analog divider 33 is wired so that its output is inputted to output terminal 6 as well as register 34. Furthermore, the output from register 34 is configured to be fed back to adder 32 through analog multiplier 35. Here, analog multiplier 31 and analog multiplier 35 are circuits for weighting and analog divider 33 is a circuit for normalizing.

If these constants for weighting are generalized as a and b, a process as is expressed by following Equation (4) is performed by the digital filter in FIG. 8.

$$Ave[n(x)]=\{a\cdot n(x)+b\cdot Ave[n(x-1]\}/\{a+b\} \quad (4)$$

In this Equation (4), it is set up so that the immediately preceding processing results of adder 32 are used to obtain the subsequent output. Therefore, the initial value for Ave[n(x)] is "0."

Figure 9:
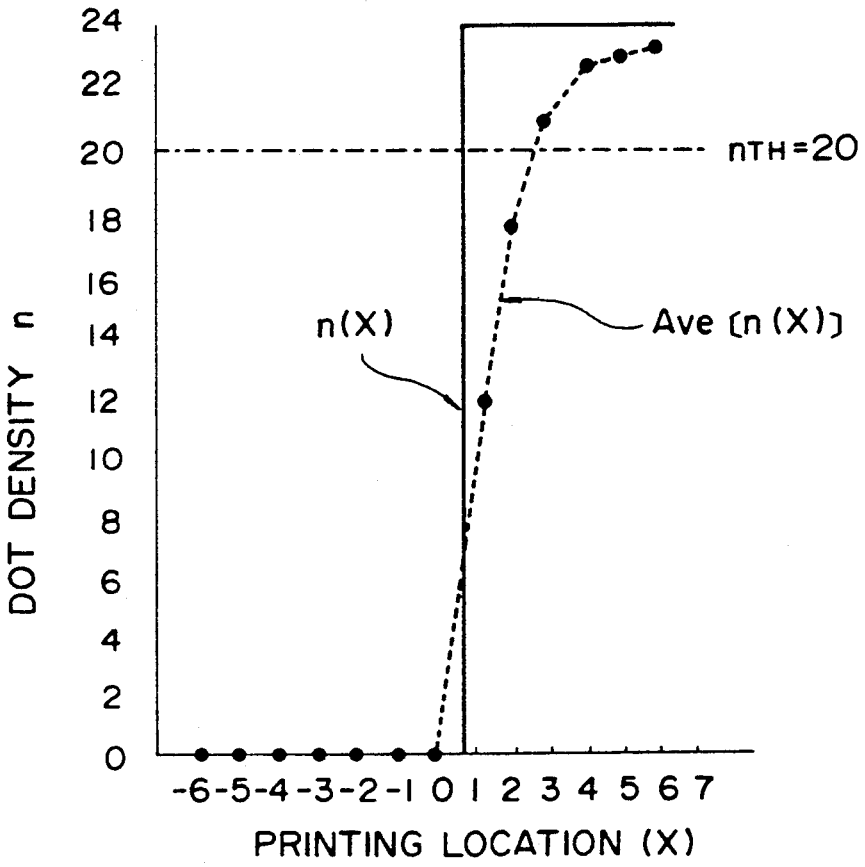
FIG. 9 is an explanatory drawing schematically showing the operation of the alternative embodiment of the digital filter.

FIG. 9 is an explanatory diagram showing the operation of the alternative embodiment of such a digital filter. The horizontal axis represents the printing location and the vertical axis printing dot density n. As is shown by the diagram, the step response of the digital filter such as the one described above changes in a manner so as to follow the curved line represented by the broken line shaped like an exponential function. If threshold level n th is set to be 20, 24 dot printing can be continued at a normal speed up to two consecutive places.

Incidentally, a single threshold level was set in the above explanation when the output of the digital filter was used to select the printing speed. However, printers are provided with various types of printing modes such as draft mode or NLQ (Near Letter Quality) mode, and the printing speed, dot interval, head driving cycle and such are determined for each of the various printing modes. Therefore, it is preferable for the weighting constant or threshold level to be switched to suit each printing mode. This can be accomplished in following manner; the weighting constants or thresholds levels which correspond to respective printing modes are tabulated in ROM in advance, and when a printing mode is designated by a host computer, the data corresponding to the printing mode is read out and set in the internal register of control section 11 to select the printing speed suitable for each of the various printing modes.

Furthermore, in order to obtain the sequential printing dot density, the printing data are developed at first in the line buffer, not illustrated, and these may be inputted to the printing dot density detection section or digital filter, but it is also acceptable for the above processes to be executed in parallel to the development of the printing data in the line buffer.

Furthermore, there are cases where the essential circuit components such as control section 11 are standardized and the printing head or power source is selected in the printer production line, depending on the printer grade. In such cases, it is preferable to have a configuration such as follows in order to implement the method of the present invention.

Figure 10:
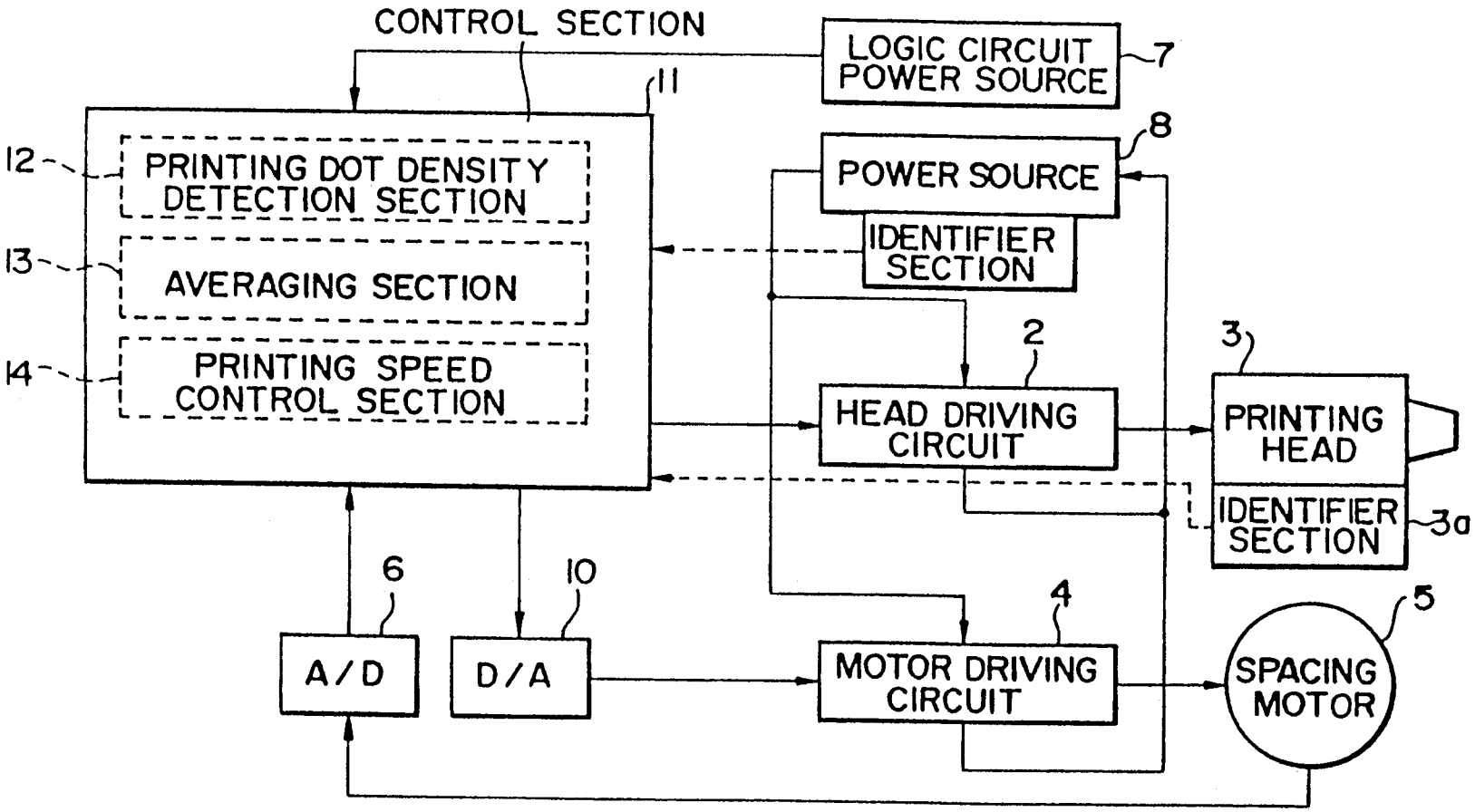
FIG. 10 is a block diagram schematically showing an alternative embodiment of a printer based on the present invention.

In FIG. 10, an alternative embodiment of the printer based on the present invention is shown. In the figure, the configuration of each component of this device is about the same as the one shown in FIG. 1 and similar components are given the same symbols. Here, in this preferred embodiment, identifier section 3*a* is added to printing head 3 and identifier section 8*a* to power source 8, respectively. Each of these identifier sections 3*a* and 8*a* is provided with two types of logic levels, such as H and L, set by a dip switch or the like to indicate the type of printing head 3 or power source 8.

Control section 11 receives the outputs from these identifiers 3*a* and 8*a* to identify what type of grade the installed printing head 3 and power source 8 belong to, whereby the threshold level is set higher for power source 8 with a large capacity or printing head 3 with higher driving performance so that high speed printing is maintained even when high density printing continues. Furthermore, in the event a power source 8 with a small capacity or a printing head 3 with low driving performance is installed, the selection of the printing speed is more carefully controlled. Thus, control modes are automatically selected depending on the prices or performance grades of the product. Therefore, the product costs can be reduced by standardizing some components.

Figure 11:
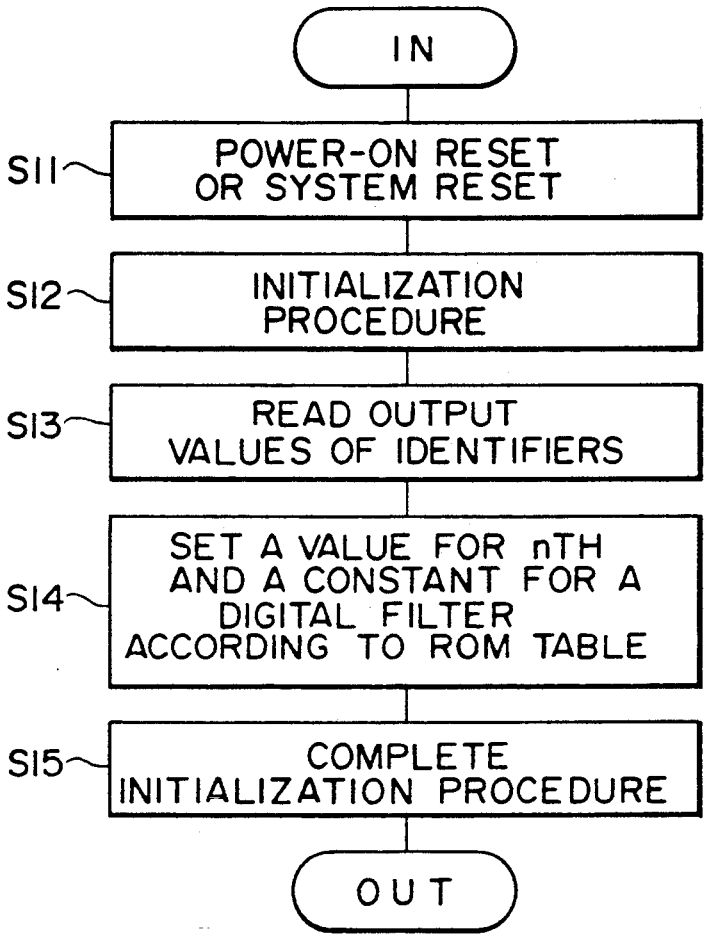
FIG. 11 is an explanatory drawing schematically showing the operation of the alternative embodiment shown in FIG. 10.

FIG. 11 shows an operational flow chart for the alternative embodiment of the device shown in FIG. 10. In the figure, if power-on reset or system reset procedure is performed at first (Step S11), the device is initialized in Step S12. In this initialization procedure, memories or inputs/outputs are checked, and initial values are set in registers and the like.

Here, the output values of identifier 3*a* and 8*a* explained in FIG. 10 are read in (Step S13), and the above mentioned threshold level n th or weighting constants for the digital filter are set by the ROM table (Step S14).

After this initialization procedure is completed (Step S15), the procedure explained in FIG. 6 is followed, where the printing speed set depending on the printing density is selected to execute printing.

For example, if two power sources with different capacities, large and small, are available, the output of identifier section 8*a* is set in advance as "H" for the power source with a large capacity and "L" for the one with a small capacity. Furthermore, threshold level n th is set as "22" for the large capacity and "20" for the small capacity, and this setting has only to be stored in advance within ROM table.

Next, in Step S13 of the flow chart in FIG. 11, if control section 11 detects that the output of identifier section 8*a* is "H," it decides that a power source with a large capacity is mounted, reads out threshold level n tn from the ROM table, and selects "22." Furthermore, the same is held for the driving performance of the printing head, so that a printing speed matching the performance is selected. In other words, the higher the performance of printing head is, the more possible it is for printing to be executed without reducing the printing speed even if the dot density of a given printing pattern is high, but on the other hand, costs increase is caused because of the requirement for high quality material or the structural complication. Therefore, in a printer using a printing head which is expensive but of high driving performance, the output of identifier section 3*a* is set to "H," and if a printing head of low driving performance is used, it is set to "L."

If the above mentioned process is performed based on the printing data for subsequent printing locations, the printing speed can be controlled to become slower before the printing dot density changes, so that at the point where the above mentioned threshold level is exceeded, that is, printing location X4, the printing speed can be slowed down to a speed which does not deteriorate print clarity. In other words, if the gradual rise of the averaged printing dot density obtained by the digital filter, and the rise and fall of acceleration/deceleration control of the spacing motor are set at approximately same rate, the acceleration/deceleration response of the spacing motor virtually follows the printing dot density changes without delay to prevent faint and dim printing or the like caused by insufficient power supply.

Figure 12:
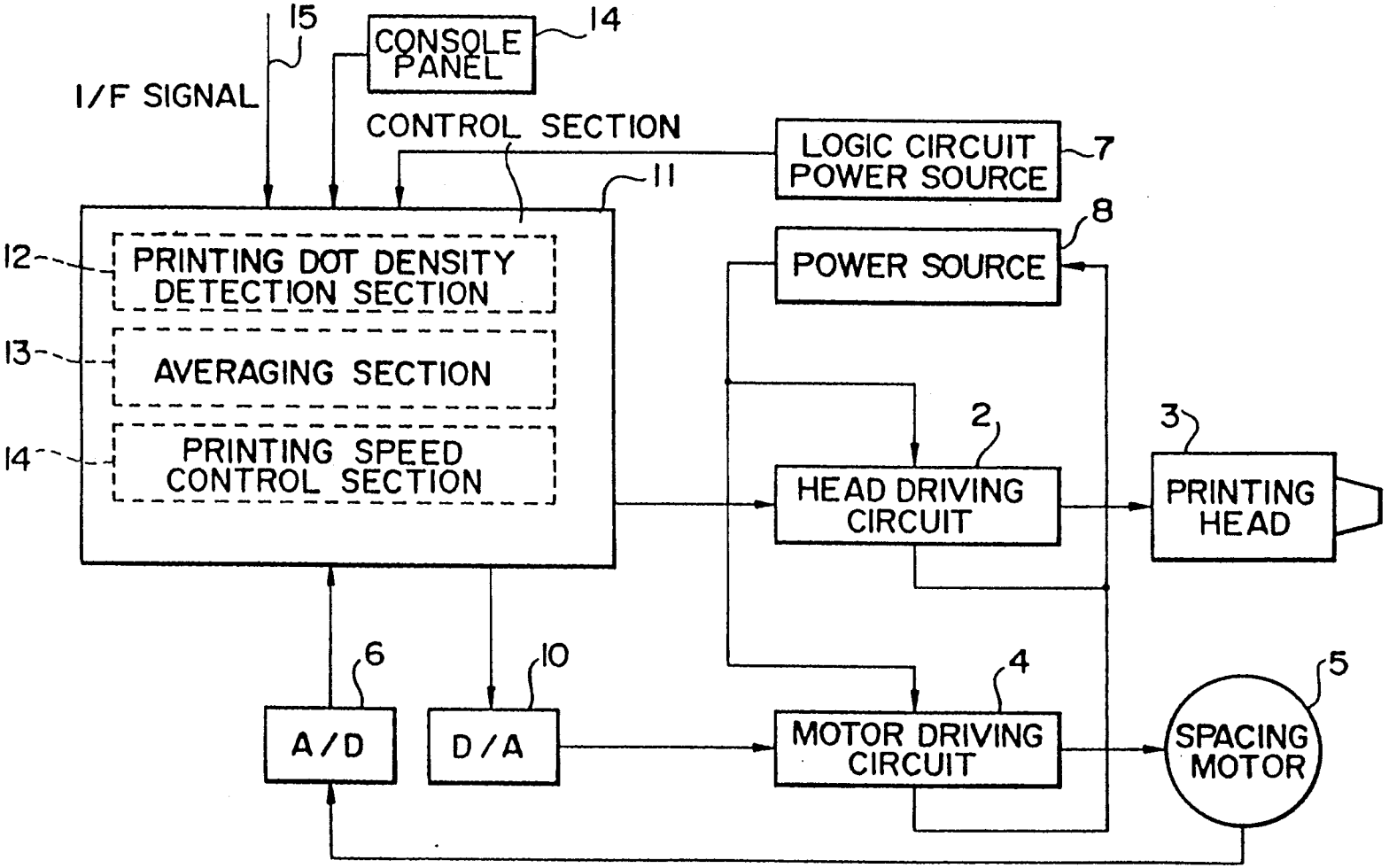
FIG. 12 is a block diagram of the essential section of a printer schematically showing another preferred embodiment.

Additionally, printer noise can be prevented in the same manner as in the above mentioned preferred embodiment. FIG. 12 is a block diagram showing the essential section of the printer of yet another alternative embodiment. In this preferred embodiment, the configuration of control section 11 and such may be the same as the preferred embodiment shown in FIG. 1, but is different in that it is configured for the signals from console panel 14, and I/F signal 15 from the host computer are inputted to control section 11. This signal from console panel 14 and the I/F signal 15 are given to control section 11 as a command to switch the normal printing speed mode and the low noise printing mode.

In this type of printer, the prescribed value for threshold level n th, which is compared to the output of averaging section 13, is defined as the maximum number of printing pins for which the noise level does not exceed the prescribed permissible value when printing is continued with a fixed number of pins, without changing the normal printing speed.

For example, if n th is set at "20," it means that when printing is continued at the printing dot number higher than 20, an impermissible amount of noise is generated because of the excessive number of impacts per unit time. Therefore, with printing dot density in which the number of printing dots is higher than 20, the printing speed must be slowed down to reduce the number of impact per unit time so that low noise printing can be performed.

On the other hand, it is rare that the number of printing dots consecutively exceeds 20 in an actual printing pattern, and in many cases, the printing locations where the number of printing dots exceeds 20 are interspersed. Therefore, if low speed printing is performed at all of these printing locations, processing capacity as a printer, namely throughput, declines. Furthermore, since human hearing is not so sensitive to a very short burst of noise, printing in which the number of printing dots exceeds 20 can be tolerated as long as it lasts only a brief moment.

Here, in this preferred embodiment, sudden sequential changes in printing dot density are averaged by the above mentioned digital filter, and the printing locations where printing dot density averages high are actually detected to select the printing speed. For example, in the example in FIG. 9 explained before, printing can be continued at a normal speed until 24 dot printing occurs three consecutive times.

Also, in this case, the function of the digital filter may be any one of those expressed by the above mentioned Equation (2), Equation (3) and Equation (4).

Figure 13:
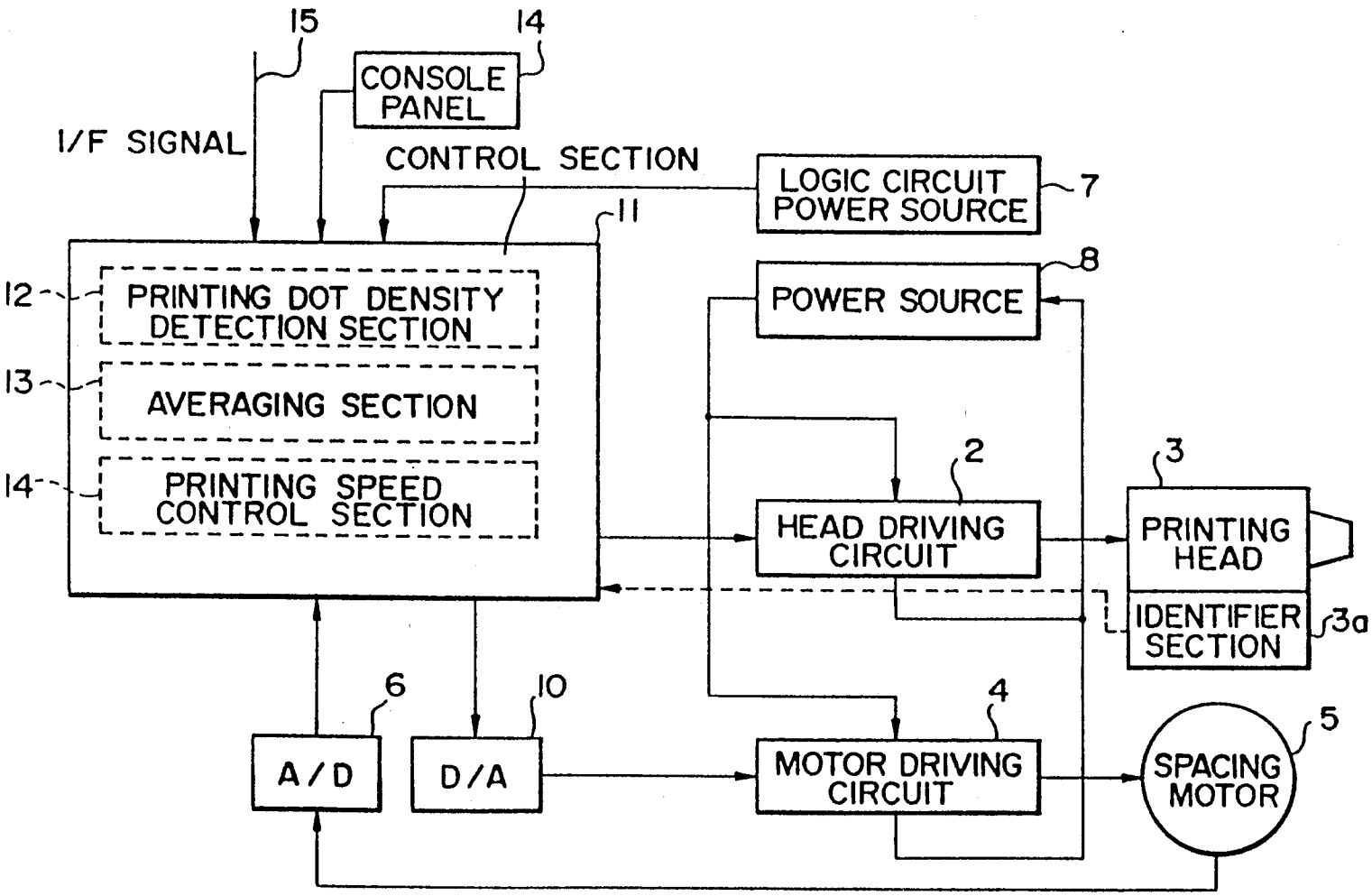
FIG. 13 is a block drawing of the essential section of a printer schematically showing yet another preferred embodiment of the present invention.

In addition, if printing head 3 with various levels of sound proof performance is used, following configuration is employed. FIG. 13 is a block diagram showing the essential section of the printer representing an alternative embodiment of the present invention. Here, in this preferred embodiment, identifier section 3*a* is added to printing head 3. This identifier section 3*a* is used to indicate the type of printing head 3 in the same manner as the device shown in FIG. 10 and is provided with two types, for example, of logic level, H or L, set by a dip switch or the like.

Control section 11 receives the output of this identifier section 3*a* and determines what grade of sound proof performance the employed printing head 3 has, whereby printing head 3 is controlled so as to set the threshold to be higher for a printing head with higher sound proof performance, so that low noise printing can be sustained even if high density printing continues. Also, in the event a printing head 3 with low sound proof performance is installed, the selection of printing speed is more carefully controlled whereby the control mode is automatically selected depending on cost or performance grades. Thus, the production costs can be lowered by standardizing some components.

Furthermore, in this preferred embodiment, its operation can also follow the same steps shown in FIG. 11. When power-on reset or system reset procedure is performed at first (Step S11), the initialization procedure is performed in Step S12. Here, the output value of identifier section 3*a* explained in FIG. 12 is read (Step S13) and the above mentioned threshold level n th and weighting constants for the digital filter are set referring to the ROM table (Step S14).

After this initialization procedure is completed (Step S15), the procedure explained in FIG. 6 is followed, whereby the printing speed set corresponding to this printing dot density is selected and printing is executed.

For example, if a printing head with two different levels of sound proof performance is prepared as printing head 3, the output of identifier section 3*a* is set in advance to "H" for high sound proof performance and "L" for low, and threshold level n th is set to "22" for high sound proof performance and threshold level n th is set to "20" for low sound proof performance, and Ave [n(x)] is expressed by Equation (5) to be stored in ROM table.

$$Ave[n(x)]=\{n(x)+n(x-1)+n(x-2)+n(x-3)\ldots+n(x-7)\}/8 \quad (5)$$

Next, in Step S13 of the flow chart in FIG. 11, if control section 11 judges that the output of identifier section 3*a* is "H," it determines that printing head 3 with higher sound proof performance has been employed and reads out "threshold level n th=22" and a constant expressed by Equation (5) from the ROM table.

If the above mentioned procedure is followed based on the printing data for subsequent printing contents, the printing speed can be controlled so as to slow down before the printing dot density changes, so that at the point where the above mentioned threshold level is exceeded, that is, printing location X4, the printing speed will have been reduced to a speed at which the predetermined noise level cannot be exceeded. In other words, the gradual rise of the averaged printing dot density obtained by the digital filter, and the rise and fall of acceleration/deceleration control of the spacing motor are set at about the same rate, the acceleration/deceleration response virtually follows the changes in printing dot density without delay, and the occurrences of high noises at the printing locations with high printing dot density can be prevented even if high speed printing is executed.

According to the printing control device and its control method based on the present invention for a printer, since the sequential change in printing dot density of the printing head is detected based on the printing data of subsequent printing contents supplied to the printing head and is averaged within a prescribed time frame to select a proper printing speed, high speed printing can be sustained as much as possible even if printing contents requiring high density printing are intermittently contained in some parts of the printing lines, but on the other hand, if high density printing locations consecutively appear, the printing speed can be controlled so as to achieve a prescribed printing speed by decelerating in advance so that printing quality can be maintained within the limits of the power source capacity, and the occurrence of high noise can be prevented as well.

With the above arrangement, the maximum printer performance can be brought out to offer high quality prints with no faint or dim spot whether high speed printing or high density printing is performed without a power source with a large capacity. Also, the maximum printing performance can be brought out from the printer capacity without generating high noises at the locations requiring high density printing, with little costs for the sound proofing or shielding of the printing head. In addition, the identifier section provided on the power source or printing head to indicate its performance can offer the convenience of allowing careful selection of a printing speed which matches the printing grade.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A printing control device for a printer having printing means and spacing control means, comprising:

printing dot density detecting means for determining printing dot density of print data to be supplied to a printing head;

averaging means interconnected to said printing dot density detecting means for averaging the printing dot density during a predetermined period of time; and printing speed control means interconnected to said averaging means for selecting a printing speed in response to an average value of printing dot density received from said averaging means and controlling said printer to print at the selected printing speed.

2. A printing control device in accordance with claim 1, wherein said printing speed control means has a plurality of printing speeds set therein, said printing speed control means selecting a higher one of the plurality of printing speeds for print data with lower printing dot density and selecting a lower one of the plurality of printing speeds for print data with higher printing dot density.

3. A printing control device in accordance with claim 1, wherein said averaging means comprises a digital filter operative in response to the printing dot density determined by said printing dot density detecting means, for averaging the printing dot density during the predetermined period of time.

4. A printing control device in accordance with claim 3, wherein said printing means comprises said printing head for receiving the print data and prints the print data with said printing head on a recording medium.

5. A printing control device in accordance with claim 4, wherein said spacing control means is connected to said printing means for controlling said printing means to transport said printing head over the recording medium; and said printing speed control means controls said spacing control means to cause said printing head to be transported at the printing speed selected.

6. A printing control device in accordance with claim 4, wherein said printing speed control means determines a printing location in which the print data to be printed has an average printing dot density higher than a predetermined reference dot density, controls said printing means to reduce a speed at which said printing head is transported into the determined printing location, and maintains the selected printing speed while said printing head is in the determined printing location.

7. A method of controlling a printer having a printing head for printing print data on a recording medium, comprising the steps of:

determining printing dot density of the print data to be supplied to the printing head;

averaging the printing dot density during a predetermined period of time on the basis of the printing dot density determined;

selecting, on the basis of the averaged printing dot density, a higher printing speed for print data with a lower printing dot density, and a lower printing speed for print data with a higher printing dot density; and controlling the printer to print at the selected printing speed.

8. A method in accordance with claim 7, further comprising the step of setting a plurality of printing speeds, prior to said step of selecting, and wherein in said step of selecting, a higher one of the plurality of printing speeds is selected for print data with lower printing dot density and a lower one of the plurality of printing speeds is selected for print data with higher printing dot density.

9. A method in accordance with claim 7, wherein said printing head is transportable over the recording medium to print the print data on the recording medium, further comprising the step of controlling said printing head to transport said printing head at the printing speed selected.

10. A method in accordance with claim 7, further comprising the steps of:

determining a printing location at which the print data to be printed has an average printing dot density higher than a predetermined reference dot density; and controlling said printing head to reduce a speed at which said printing head is transported into the determined printing location and maintaining the selected printing speed while said printing head is in the determined printing location.

* * * * *